US010794539B1

(12) United States Patent
Duensing et al.

(10) Patent No.: US 10,794,539 B1
(45) Date of Patent: Oct. 6, 2020

(54) SYSTEMS AND PROCESSES FOR RECOVERING A VAPOR FROM A VESSEL

(71) Applicant: SOFEC, INC., Houston, TX (US)

(72) Inventors: Martin Matthew Duensing, Cypress, TX (US); Samuel David Waronoff, Katy, TX (US); Abbas Nalwala, Cypress, TX (US); Arun Sanjay Duggal, Houston, TX (US); Yonghui Liu, Houston, TX (US); Asis Nandi, Houston, TX (US); Ramachandran Gopalakrishnan, Richmond, TX (US)

(73) Assignee: SOFEC, INC., Houston, TX (US)

( * ) Notice: Subject to any disclaimer, the term of this patent is extended or adjusted under 35 U.S.C. 154(b) by 0 days.

(21) Appl. No.: 16/739,432

(22) Filed: Jan. 10, 2020

Related U.S. Application Data

(60) Provisional application No. 62/944,198, filed on Dec. 5, 2019.

(51) Int. Cl.
*F17C 9/00* (2006.01)
*B63B 22/02* (2006.01)

(52) U.S. Cl.
CPC ..... *F17C 9/00* (2013.01); *F17C 2205/0352* (2013.01); *F17C 2270/0126* (2013.01)

(58) Field of Classification Search
CPC ... B63B 22/021; B63B 22/023; B63B 22/035; B63B 22/026; F17C 9/00
See application file for complete search history.

(56) References Cited

U.S. PATENT DOCUMENTS 3,118,155 A 1/1964 Siegel
3,236,267 A 2/1966 Bily
3,602,174 A 8/1971 Gorman
(Continued)

FOREIGN PATENT DOCUMENTS

EP 0796784 A1 9/1997
EP 1178922 B1 8/2004
(Continued)

OTHER PUBLICATIONS

PCT Written Opinion and International Search Report of international application No. PCT/US2010/060104 dated Feb. 14, 2011.

*Primary Examiner* — Frantz F Jules
*Assistant Examiner* — Erik Mendoza-Wilkenfel
(74) *Attorney, Agent, or Firm* — Edmonds & Cmaidalka, P.C.

(57) ABSTRACT

Systems and processes for recovering a gas from a vessel. The system can include a buoy that can include a fluid swivel assembly. The fluid swivel assembly can have a first swivel section rotatably coupled to a second swivel section. The system can also include a first liquid transfer conduit, a first gas transfer conduit, a second liquid transfer conduit, and a second gas transfer conduit. The first swivel section and the second swivel section can be configured to maintain fluid communication between the first liquid transfer conduit and the second liquid transfer conduit. The first swivel section and the second swivel section can be configured to maintain fluid communication between the first gas transfer conduit and the second gas transfer conduit. The first gas transfer conduit and the second gas transfer conduit can be configured to convey a gas from a vessel to a subsea location.

23 Claims, 9 Drawing Sheets

(56) References Cited

U.S. PATENT DOCUMENTS 3,641,602 A 2/1972 Flory et al.
3,677,310 A 7/1972 Dobler et al.
3,722,223 A 3/1973 Gratz
3,840,927 A 10/1974 Reid, Jr.
3,969,781 A * 7/1976 Reid, Jr. ..... B63B 22/021 441/5
3,979,785 A 9/1976 Flory
4,065,822 A 1/1978 Wilbourn
4,173,804 A 11/1979 Duc
4,176,615 A 12/1979 Reid et al.
4,176,986 A 12/1979 Taft et al.
4,226,204 A 10/1980 Tuson
4,310,937 A * 1/1982 Karl ..... B63B 22/021 441/5
4,320,545 A 3/1982 Pomonik
4,321,720 A 3/1982 Havre
4,339,002 A 7/1982 Gibbs
4,490,121 A 12/1984 Coppens et al.
4,501,525 A * 2/1985 Grundy ..... B63B 22/021 141/279
4,516,942 A 5/1985 Pedersen
4,530,302 A 7/1985 Pedersen
4,556,340 A 12/1985 Morton
4,568,295 A 2/1986 Poldervaart
4,637,335 A 1/1987 Pollack
4,648,848 A 3/1987 Busch
4,825,797 A 5/1989 Poldervaart et al.
4,836,813 A 6/1989 Poldervaart
4,891,495 A 1/1990 Araki
4,892,495 A 1/1990 Svensen
4,906,137 A 3/1990 Maloberti et al.
5,564,957 A 10/1996 Breivik et al.
5,927,224 A 7/1999 Etheridge et al.
6,021,848 A 2/2000 Breivik et al.
6,109,989 A 8/2000 Kelm et al.
6,227,135 B1 5/2001 Pedersen
6,415,828 B1 7/2002 Duggal et al.
6,439,147 B2 8/2002 Cottrell et al.
6,558,215 B1 5/2003 Boatman
6,688,930 B2 2/2004 Cottrell et al.
6,932,015 B2 8/2005 Storvoll et al.
7,416,025 B2 8/2008 Bhat et al.
8,430,170 B2 4/2013 Pionetti et al.
8,763,549 B2 7/2014 Liu et al.
2001/0029879 A1 10/2001 Cottrell et al.
2004/0094082 A1 5/2004 Boatman et al.
2011/0268508 A1* 11/2011 Witz ..... F16L 11/14 405/169
2012/0085544 A1* 4/2012 Shilling ..... F04B 17/05 166/345
2012/0273213 A1* 11/2012 Blalock ..... E21B 33/038 166/341
2013/0240085 A1 9/2013 Hallot et al.
2015/0226358 A1* 8/2015 Boatman ..... F16L 39/06 285/272

FOREIGN PATENT DOCUMENTS

WO 97/00806 1/1997
WO 99/57413 11/1999

* cited by examiner

SYSTEMS AND PROCESSES FOR RECOVERING A VAPOR FROM A VESSEL

CROSS-REFERENCE TO RELATED APPLICATION

This application claims priority to U.S. Provisional Patent Application No. 62/944,198, filed on Dec. 5, 2019, which is incorporated by reference herein.

BACKGROUND

Field

Embodiments described generally relate to offshore single point mooring marine terminals. More particularly, such embodiments relate to offshore mooring buoys configured to convey fluids to and from a vessel moored thereto and processes for using same.

Description of the Related Art

In the drilling, production, and transportation of offshore liquid hydrocarbons, mooring buoys have been used to connect floating vessels to loading/unloading capabilities away from shore. A single point mooring (SPM) marine terminal includes a loading/unloading buoy anchored offshore that serves as a mooring link between geostatic subsea pipeline end manifold (PLEM) connections and the floating vessels. The buoy includes a material transfer system that transports liquid hydrocarbons between the pipeline end manifold and the vessel, for example from the pipeline end manifold into a vessel storage tank. The buoy connects to the pipeline end manifold using one or more submarine conduits, riser lines, or hoses. The pipeline end manifolds connect to pipelines that carry liquid hydrocarbons to and from near-shore or on-shore facilities or locations for distribution and/or processing.

During loading operations, a vessel is moored to a conventional single point mooring marine terminal. One or more floating transport lines or hoses are placed in fluid communication with the vessel storage tank and the single point mooring marine terminal. Liquid hydrocarbons are then conveyed from the pipeline, through the submarine lines, through the buoy, through the floating transport lines, and into the vessel storage tank(s). Conventional liquid hydrocarbon carrying vessel storage tanks are designed to safely operate within specified pressure ranges. As the liquid hydrocarbon is introduced into the vessel storage tank gas within the tank is displaced such that a pressure within the vessel storage tank can be maintained within the specified ranges. Current processes for controlling the pressure within the tank include venting, displacing, or discharging the vapors/gases directly to the atmosphere.

There is a need, therefore, for improved systems and processes for capturing gas displaced from vessel storage tanks during loading operations that avoid or substantially reduce gases from being introduced into the atmosphere.

SUMMARY

Systems and processes for recovering a gas from a vessel are provided. In one embodiment, the system can include a buoy that can include a fluid swivel assembly coupled thereto. The fluid swivel assembly can include a first swivel section rotatably coupled to a second swivel section. The system can also include a first liquid transfer conduit, a first gas transfer conduit, a second liquid transfer conduit, and a second gas transfer conduit. The first swivel section and the second swivel section can be configured to maintain fluid communication between the first liquid transfer conduit and the second liquid transfer conduit. The first swivel section and the second swivel section can be configured to maintain fluid communication between the first gas transfer conduit and the second gas transfer conduit. The first gas transfer conduit and the second gas transfer conduit can be configured to convey a gas from a vessel to a subsea location.

In one embodiment, the process for recovering gas from a vessel can include flowing a gas displaced from a vessel storage tank through a first gas transfer conduit, through a floating buoy, and through a second gas transfer conduit to a first subsea location. The process can also include flowing a liquid from a second subsea location through a first liquid transfer conduit, through the floating buoy, and through a second liquid transfer conduit into the vessel storage tank.

BRIEF DESCRIPTION OF THE DRAWINGS

The various aspects and advantages of the preferred embodiment of the present invention will become apparent to those skilled in the art upon an understanding of the following detailed description of the invention, read in light of the accompanying drawings which are made a part of this specification.

DETAILED DESCRIPTION

Figure 1:
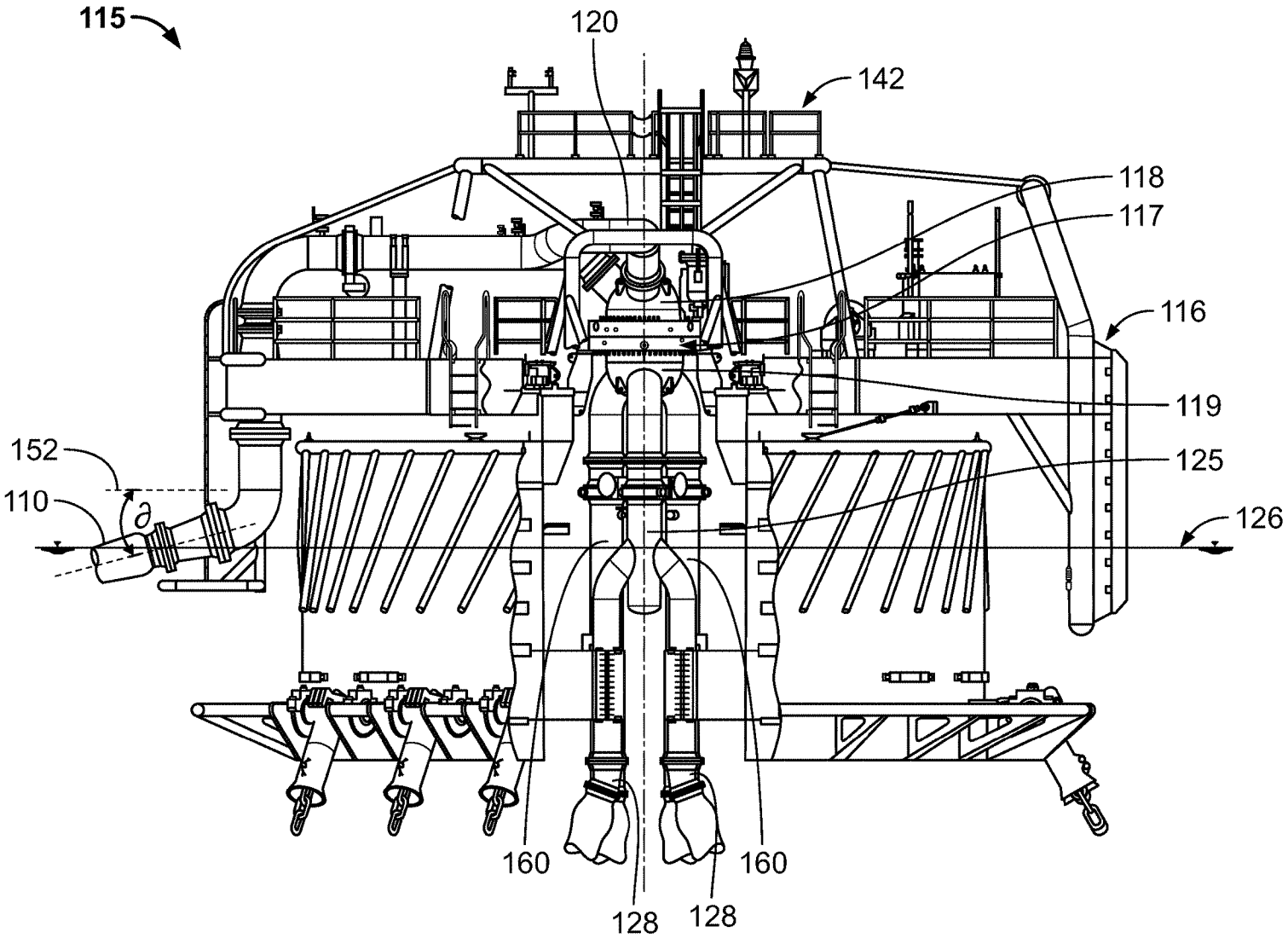
FIG. 1 depicts a schematic elevation view of an illustrative buoy, according to one or more embodiments.

A detailed description will now be provided. Each of the appended claims defines a separate invention, which for infringement purposes is recognized as including equivalents to the various elements or limitations specified in the claims. Depending on the context, all references to the "invention", in some cases, refer to certain specific or preferred embodiments only. In other cases, references to the "invention" refer to subject matter recited in one or more, but not necessarily all, of the claims. It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows includes embodiments in which the first and second features are formed in direct contact and also includes embodiments in which additional features are formed interposing the first and second features, such that the first and second features are not in direct contact. The exemplary embodiments presented below may be combined in any combination of ways, i.e., any element from one exemplary embodiment may be used in any other exemplary embodiment, without departing from the scope of the disclosure. The figures are not necessarily drawn to scale and certain features and certain views of the figures can be shown exaggerated in scale or in schematic for clarity and/or conciseness.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Also, the naming convention used herein is not intended to distinguish between components that differ in name but not function. Furthermore, in the following discussion and in the claims, the terms "including" and "comprising" are used in an open-ended fashion, and thus should be interpreted to mean "including, but not limited to."

All numerical values in this disclosure are exact or approximate values ("about") unless otherwise specifically stated. Accordingly, various embodiments of the disclosure may deviate from the numbers, values, and ranges disclosed herein without departing from the intended scope.

Further, the term "or" is intended to encompass both exclusive and inclusive cases, i.e., "A or B" is intended to be synonymous with "at least one of A and B," unless otherwise expressly specified herein. The indefinite articles "a" and "an" refer to both singular forms (i.e., "one") and plural referents (i.e., one or more) unless the context clearly dictates otherwise. The terms "up" and "down"; "upward" and "downward"; "upper" and "lower"; "upwardly" and "downwardly"; "above" and "below"; and other like terms used herein refer to relative positions to one another and are not intended to denote a particular spatial orientation since the apparatus and methods of using the same may be equally effective at various angles or orientations.

Figure 2:
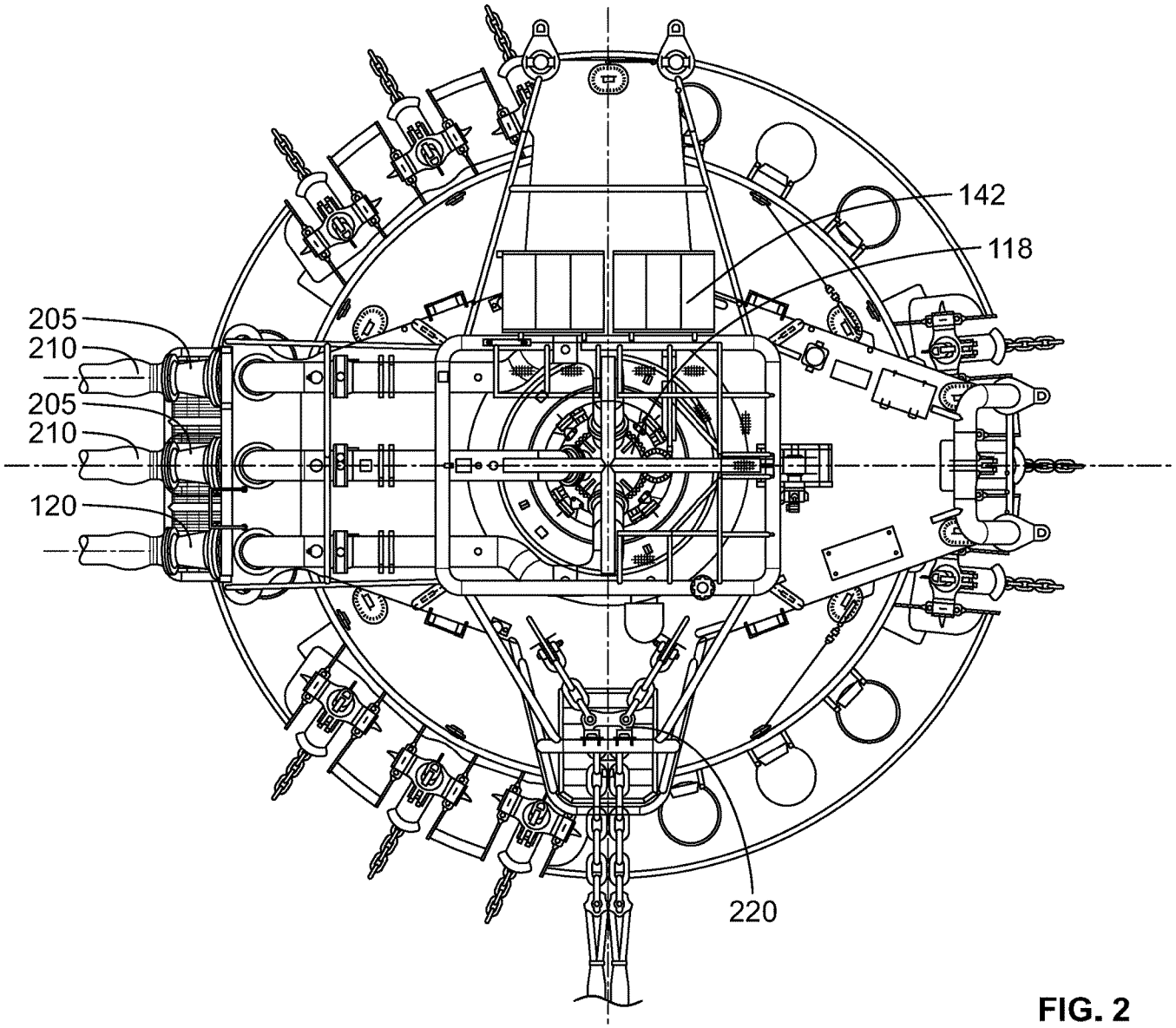
FIG. 2 depicts a schematic plan view of the buoy shown in FIG. 1.

FIG. 1 depicts a schematic elevation view of an illustrative buoy 115, according to one or more embodiments. FIG. 2 depicts a schematic plan view of the buoy 115 shown in FIG. 1. The buoy 115 can float in a body of water 126 and can include a fluid swivel assembly 117 coupled thereto. The fluid swivel assembly 117 can include a first swivel section 118 rotatably coupled to a second swivel section 119. A first gas transfer conduit 120 can be in fluid communication with the first swivel section 118 and a second gas transfer conduit 125 can be in fluid communication with the second swivel section 119. The first gas transfer conduit 120 can be in fluid communication with a first flow path defined by the first swivel section 118 and the second gas transfer conduit 125 can be in fluid communication with a first flow path defined by the second swivel section 119. In some examples, the second gas transfer conduit 125 can extend from the second swivel section 119 and transition into two or more second gas transfer conduits 128 (two are shown). The first swivel section 118 and the second swivel section 119 can be adapted or configured to maintain fluid communication between the first gas transfer conduit 120 and the second gas transfer conduit 125 during rotation therebetween and when there is no rotation therebetween. The first gas transfer conduit 120 and the second gas transfer conduit 120 can be adapted or configured to convey a gas from a vessel to a subsea location, e.g., a first pipeline end manifold.

The buoy 115 can also include a first liquid transfer conduit 160 (two are shown) and a second liquid transfer conduit 205 (two are shown). The first liquid transfer conduit 160 can be in fluid communication with the second swivel section 119 and the second liquid transfer conduit 205 can be in fluid communication with the first swivel section 118. The first liquid transfer conduit 160 can be in fluid communication with a second flow path defined by the second swivel section 119 and the second liquid transfer conduit 205 can be in fluid communication with a second flow path defined by the first swivel section 118. The first swivel section 118 and the second swivel section 119 can be adapted or configured to maintain fluid communication between the first liquid transfer conduit 160 and the second liquid transfer conduit 205 during rotation therebetween and when there is no rotation therebetween. The first liquid transfer conduit 160 and the second liquid transfer conduit 205 can be adapted or configured to convey a liquid from a subsea location, e.g., a second pipeline end manifold, to the vessel.

A first floating conduit 110 can be in fluid communication with the first gas transfer conduit 120. As further described below, the first floating conduit 110 can be adapted or configured to convey a gas. An end of the first gas transfer conduit 120 can be coupled to an end of the first floating conduit 110. A second floating conduit 210 (two are shown) can be in fluid communication with the second liquid transfer conduit 205. As further described below, the second floating conduit 210 can be adapted or configured to convey a liquid. An end of the second liquid transfer conduit 205 can be coupled to an end of the second floating conduit 210. The end of the first gas transfer conduit 120 and the end of the second liquid transfer conduit 205 can have a declination angle $\partial$ relative to a local horizontal 152 of the buoy 115. Accordingly, a portion of the first floating conduit 110 can have the declination angle $\partial$. In some embodiments, the declination angle $\partial$ can be from about one degree, about five degrees, or about 10 degrees to about 20 degrees, about 30 degrees, or about forty degrees from the local horizontal 152. It should be noted that the local horizontal 152 may stay static with regard to the buoy 115 while a declination angle relative to a surface of a body of water 126 may change with wave action and other perturbations of the buoy 115.

The buoy 115 can be adapted or configured as a mooring terminal via a mooring uni-joint 220 disposed on the buoy 115. In some embodiments, electric power for safety lights and other equipment can be produced by a solar panel and power storage assembly 142 disposed on the buoy 115, for example on an upper surface of the buoy 115. In other embodiments, the electric power can be provided via a power cable from an alternate location, for example, on-shore or a near-by platform, buoy, or other structure.

Figure 3:
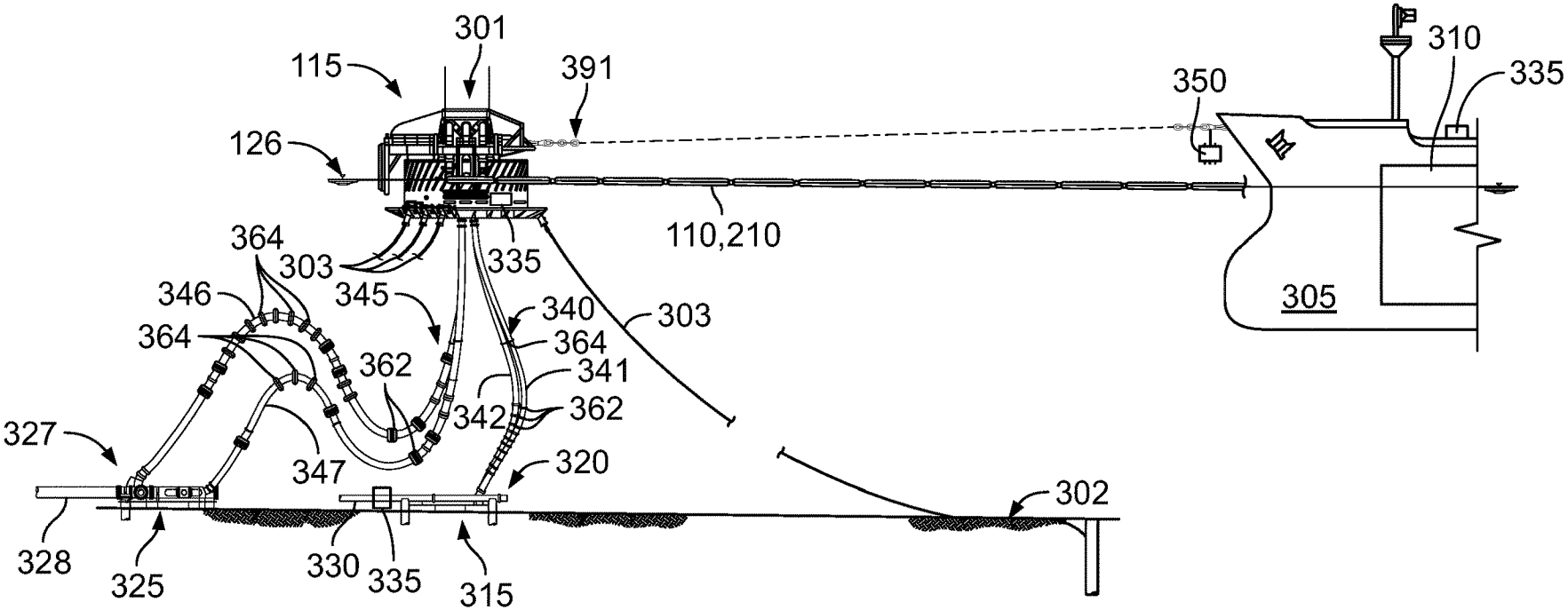
FIG. 3 depicts a schematic elevation view of an illustrative single point mooring marine terminal having a floating vessel moored thereto, according to one or more embodiments.
Figure 4:
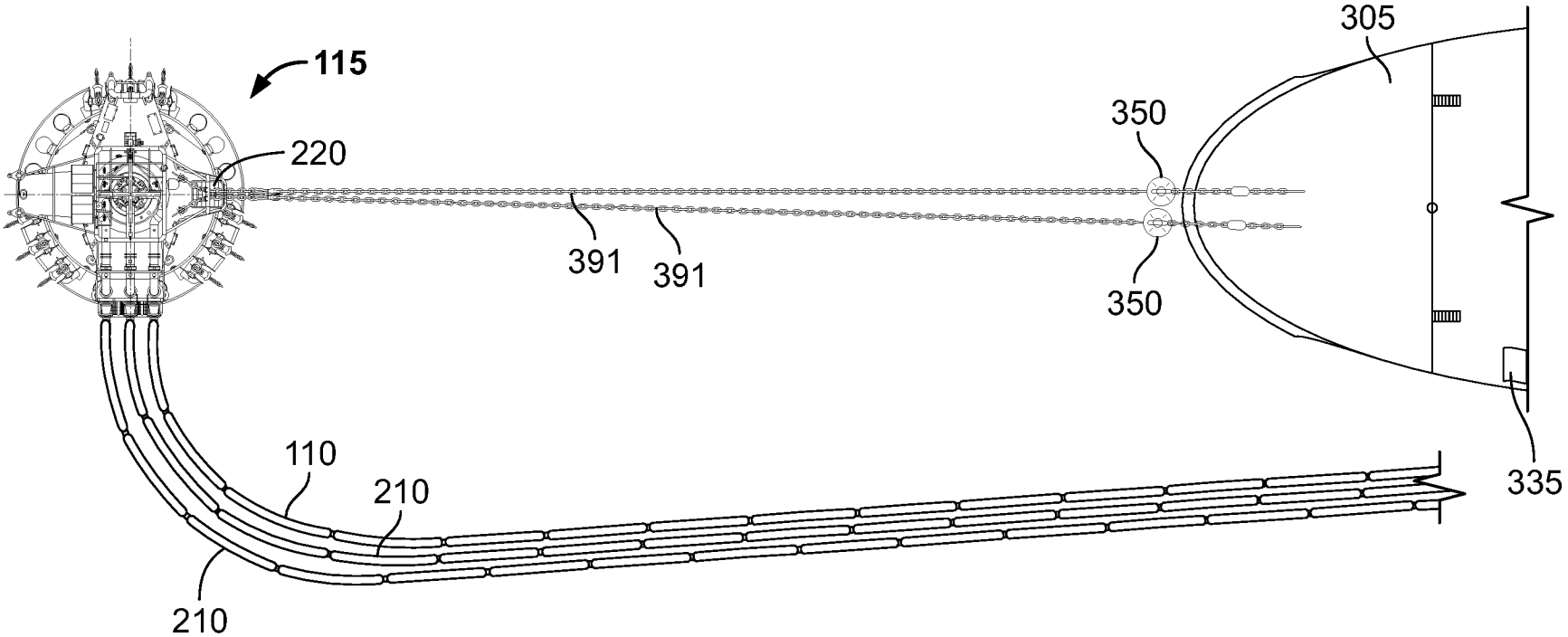
FIG. 4 depicts a schematic plan view of the single point mooring marine terminal shown in FIG. 3.

FIG. 3 depicts a schematic elevation view of an illustrative single point mooring marine terminal 301 having a floating vessel 305 moored thereto, according to one or more embodiments. FIG. 4 depicts a schematic plan view of the single point mooring marine terminal 301 shown in FIG. 3. The floating vessel 305 can include a vessel storage tank 310 that can include the gas. For example, the floating vessel 305 can be a floating production, storage, and offloading (FPSO) vessel, a floating storage and offloading (FSO) vessel, or a conventional liquid carrying tanker which may be a very large crude carrier (VLCC), an ultra large crude carrier (ULCCs), or any other size liquid carrying tanker. The buoy 115 can be floating in the body of water 126 and can be adapted or configured as a single point mooring marine terminal 301.

The floating vessel 305 can be moored to the buoy 115. In some examples, the vessel 305 can be moored to the buoy 115 via a Hawser arrangement 391. The Hawser arrangement 391 can be or can include a nylon rope, which can be shackled to the mooring uni-joint 220 on the buoy 115. A load pin 350 can be applied to the Hawser arrangement 391 to measure hawser loads. The Hawser arrangement 391 can be adapted or configured with one or more ropes depending, at least in part, on the tonnage of the floating vessel 305. The ropes can be single-leg or grommet leg type ropes. By "vessel" it can be meant any type of floating structure including but not limited to tankers, boats, ships, and the like.

Referring now to FIGS. 1, 3, and 4, in some examples the buoy 115 can be a catenary anchor leg mooring (CALM) type buoy, as depicted, or as a single anchor leg mooring (SALM) type buoy as described below. In some examples, the buoy 115 can be or can include the turntable 116 rotatably coupled to the buoy 115, as depicted, which is typically referred to as a "turntable buoy". In other examples, the buoy 115 can be or can include a rotatable floating buoy coupled to a relatively geostationary turret, which is typically referred to as a "turret buoy". On a turret buoy, the turret can be suspended from a rotatable floating buoy and the turret can be coupled to the seafloor 302. The fluid swivel assembly 117 can be coupled to the turntable 116 or the rotatable floating buoy. As such, the buoy 115 can be what is typically called a turret buoy, a turntable buoy, or a single anchor leg mooring type buoy. The buoy 115 can be coupled or otherwise secured to the seafloor 302 by one or more anchor legs 303. The buoy 115 can be held in a relatively geostationary condition by the one or more anchor legs 303. The floating vessel 305 can be moored to the turntable 116 or the rotatable floating turret and can weathervane about or with the buoy 115, respectively.

The second gas transfer conduit 125 can be in fluid communication with a gas submarine conduit 340 (two are shown) and a first pipeline end manifold 315 located at a first subsea location 320. In some embodiments, the gas submarine conduit 340 can include a first submarine conduit 341 and a second submarine conduit 342. The gas submarine conduit 340 can be in fluid communication with the first pipeline end manifold 315 and the second gas transfer conduit 125. In some embodiments, the gas submarine conduit 340 can be coupled between the first pipeline end manifold 315 and the two or more second gas transfer conduits 128 for fluid communication therebetween. The first pipeline end manifold 315 can be in fluid communication with a gas pipeline 330.

The first liquid transfer conduit 160 can be in fluid communication with a liquid submarine conduit 345 (two are shown) and a second pipeline end manifold 325 located at a second subsea location 327. The second pipeline end manifold 325 can be in fluid communication with a liquid pipeline 328.

The first floating conduit 110 can be in fluid communication with the vessel storage tank 310. The second gas transfer conduit 125 can be in fluid communication with the first pipeline end manifold 315, e.g., via the gas submarine conduit 340. In some embodiments, the two or more second gas transfer conduits 128 can be in fluid communication with the first pipeline end manifold 315, e.g., via the gas submarine conduits 341, 342. The first floating conduit 110, the first gas transfer conduit 120, the fluid swivel assembly 117, the second gas transfer conduit 125, and the gas submarine conduits 340 can be adapted or configured to transfer or convey the gas displaced or otherwise conveyed from the vessel 305, e.g., from the vessel storage tank 310, to the first pipeline end manifold 315 located at the first subsea location 320.

The gas pipeline 330 can be in fluid communication with and span from the first pipeline end manifold 315 to another location, such as a near-shore or on-shore facility or location. The first floating conduit 110, the first gas transfer conduit 120, the second gas transfer conduit 125, the gas submarine conduit 340, the first pipeline end manifold 315, and the gas pipeline 330 can be adapted or configured to transfer or convey the gas from the floating vessel 305, e.g., the vessel storage tank 310, to the near-shore or on-shore location.

The liquid pipeline 328 can be in fluid communication with and span from the second pipeline end manifold 325 to another location, such as the near-shore or on-shore facility or location. The second pipeline end manifold 325 can be in fluid communication with the first liquid transfer conduit 160. The second liquid transfer conduit 205 can be in fluid communication with a second floating conduit 210 (two are shown). The second floating conduit 210 can be in fluid communication with the vessel 305, e.g., the vessel storage tank 310. The liquid pipeline 328, the second pipeline end manifold 325, the liquid submarine conduits 345, the first liquid transfer conduit 160, the fluid swivel assembly 117, the second liquid transfer conduit 205, and the second floating conduit 210 can be adapted or configured to convey a liquid, for example a liquid hydrocarbon, from the near-shore or on-shore location to the vessel 305, e.g., the vessel storage tank 310.

The gas can be displaced from the vessel storage tank 310 to keep a pressure within the vessel storage tank 310 within specified ranges when introducing a liquid into the vessel storage tank 310. In some examples, the gas can be or can include an exhaust gas, air, an inert gas such as nitrogen or carbon dioxide, hydrocarbon gas, or any mixture thereof. The gas in the vessel storage tank 310 can be displaced from the vessel storage tank 310 simultaneously with the introduction of the liquid into the vessel storage tank 310. The liquid introduced into the vessel storage tank 310 can be or can include, but is not limited to, water, raw hydrocarbons such as crude oil or a fraction thereof, refined hydrocarbons such as, but not limited to, diesel fuel, jet fuel, kerosene, and/or gasoline, or any mixture thereof.

In some examples, the gas submarine conduit 340 can be configured in a Chinese lantern configuration between the buoy 115 and the first subsea location 320. For example, the first and second submarine conduits 341, 342 can each include one or more negatively buoyant members 362 coupled thereto between the first pipeline end manifold 315 and the second gas transfer conduit 125. In some examples, the one or more negatively buoyant members 362 can be coupled thereto between the first pipeline end manifold 315 and a midpoint of each of the first and second submarine conduits 341, 342. In other examples, the one or more negatively buoyant members 362 can be coupled to the first and second submarine conduits 341, 342 between the first pipeline end manifold 315 and the midpoint of each of the first and second submarine conduits 341, 342 and one or more negatively buoyant members 362 can be coupled to each of the first and second submarine conduits 341, 342 between the midpoint and the second gas transfer conduit 125. In still other examples, the first and second submarine conduits 341, 342 can include one or more negatively buoyant members 362 and one or more positively buoyant members 364 coupled thereto between the first pipeline end manifold 315 and the second gas transfer conduit 125. The positively buoyant member(s) 364, if present, can be located between the midpoint and the second gas transfer conduit 125, between the first pipeline end manifold 315 and the midpoint, or a combination thereof. As such, in some examples, one or more negatively buoyant members 362 and one or more positively buoyant members 364 can be distributed along the first and second submarine conduits 341, 342 to maintain the first and second submarine conduits 341, 342 in the Chinese lantern configuration.

The one or more negatively buoyant members 362 can urge each of the first and second submarine conduits 341, 342 toward the seafloor 302 to maintain the first and second submarine conduits 341, 342 in the Chinese lantern configuration. In other examples, the gas submarine conduit 340 can be adapted or configured in a steep-S configuration or a lazy-S configuration between the buoy 115 and the first subsea location 320. The one or more negatively buoyant members 362 can be made from any suitable material that can sink in water, e.g., sea water. For example, the one or more negatively buoyant members 362 can be made from or include metal chains, cement, lead, natural stone, a metal alloy, or other suitable materials. The one or more negatively buoyant members 162 can be made from any suitable material that can sink in water, including sea water. For example, the one or more negatively buoyant members 162 can be made from or include metal chains, cement, lead, natural stone, metal alloy, or other suitable materials. The one or more positively buoyant members 364 can be made from or include syntactic foams, foamed thermoset or thermoplastic materials, thermoset or thermoplastic materials filled with particles (such as glass, plastic, micro-spheres, and/or ceramics), rubber, nylon, composites of these materials, any other material buoyant in water, e.g., sea water, or any combination thereof.

In some examples, the liquid submarine conduit 345 can include a third submarine conduit 346 and a fourth submarine conduit 347. The liquid submarine conduit 345 can be in fluid communication with the second pipeline end manifold 325 and the first liquid transfer conduit 160. The liquid submarine conduit 345 can be coupled between the second pipeline end manifold 325 and the first liquid transfer conduit 160. The liquid submarine conduit 345 can be adapted or configured in a Chinese lantern configuration, a steep-S configuration, or a lazy-S configuration between the buoy 115 and the second subsea location 327. For example, one or more negatively buoyant members 362 and one or more positively buoyant members 364 can be distributed along each of the third and fourth submarine conduits 346, 347 to maintain the third and fourth submarine conduits 346, 347 in the Chinese lantern configuration, the steep-S configuration, or the lazy-S configuration.

The gas submarine conduit 340 and liquid submarine conduit 345 can be flexible and can be any type of elongated conduit. The gas submarine conduit 340 and the liquid submarine conduit 345 can be adapted or configured to compensate for motions of the buoy 115. Any of the conduits, e.g., the first floating conduit 110, the second floating conduit 210, the gas submarine conduit 340, the liquid submarine conduit 345, etc., can be made from any suitable material. For example, the conduits can be made from a synthetic fiber such as polyester or nylon filament, rubber, synthetic rubbers, metal alloys, or other suitable materials. It should also be understood that any of the conduits, e.g., the first floating conduit 110, the second floating conduit 210, the gas submarine conduit 340, the liquid submarine conduit 345, etc., can each be or can each include a single conduit segment or a plurality of conduit segments connected together.

In some examples, the pressure developed within the vessel storage tank 310 during liquid loading may not be sufficient to push the gas all the way through the gas pipeline 330. Accordingly, one or more blowers 335 (three are shown) can be used to maintain the pressure within the vessel storage tank 310 within specified design ranges and/or can be used to move or otherwise urge the gas from the vessel storage tank 310 through the pipeline 330. In some examples the blower 335 can be located at the first subsea location 320, on the buoy 115, floating adjacent the buoy 115, on the floating vessel 305, on an adjacent platform, and/or on shore in fluid communication with the gas pipeline 330. The blower 335 can be adapted or configured to provide a propulsive force within the conduits to assist the gas conveyance through the pipeline 330. For example, the blower 335 can increase a mass flow of the gas that can be conveyed from the vessel storage tank 310 through the pipeline 330 to another location such as the near-shore or on-shore facility or location. The blower 335 can induce or otherwise produce a partial vacuum and/or increase a pressure within the gas pipeline 330, the first pipeline end manifold 315, the second gas transfer conduit 125, the first floating conduit 110 and/or the first gas transfer conduit 120, to draw or otherwise urge the gas from the vessel 305 such that the gas can be conveyed to another location, such as the near-shore or on-shore facility or location.

The gas, once conveyed to the near-shore or on-shore facility or location, can be processed to reduce or remove at least a portion of one or more contaminants therefrom. In some examples, the gas can be an exhaust gas from the vessel that can include one or more contaminants Such contaminants can be or can include, but are not limited to, oxides of sulfur (SOx), oxides of nitrogen (NOx), carbon monoxide, carbon dioxide, hydrocarbons, and carbon particles suspended in the gas, or any mixture thereof.

Figure 5:
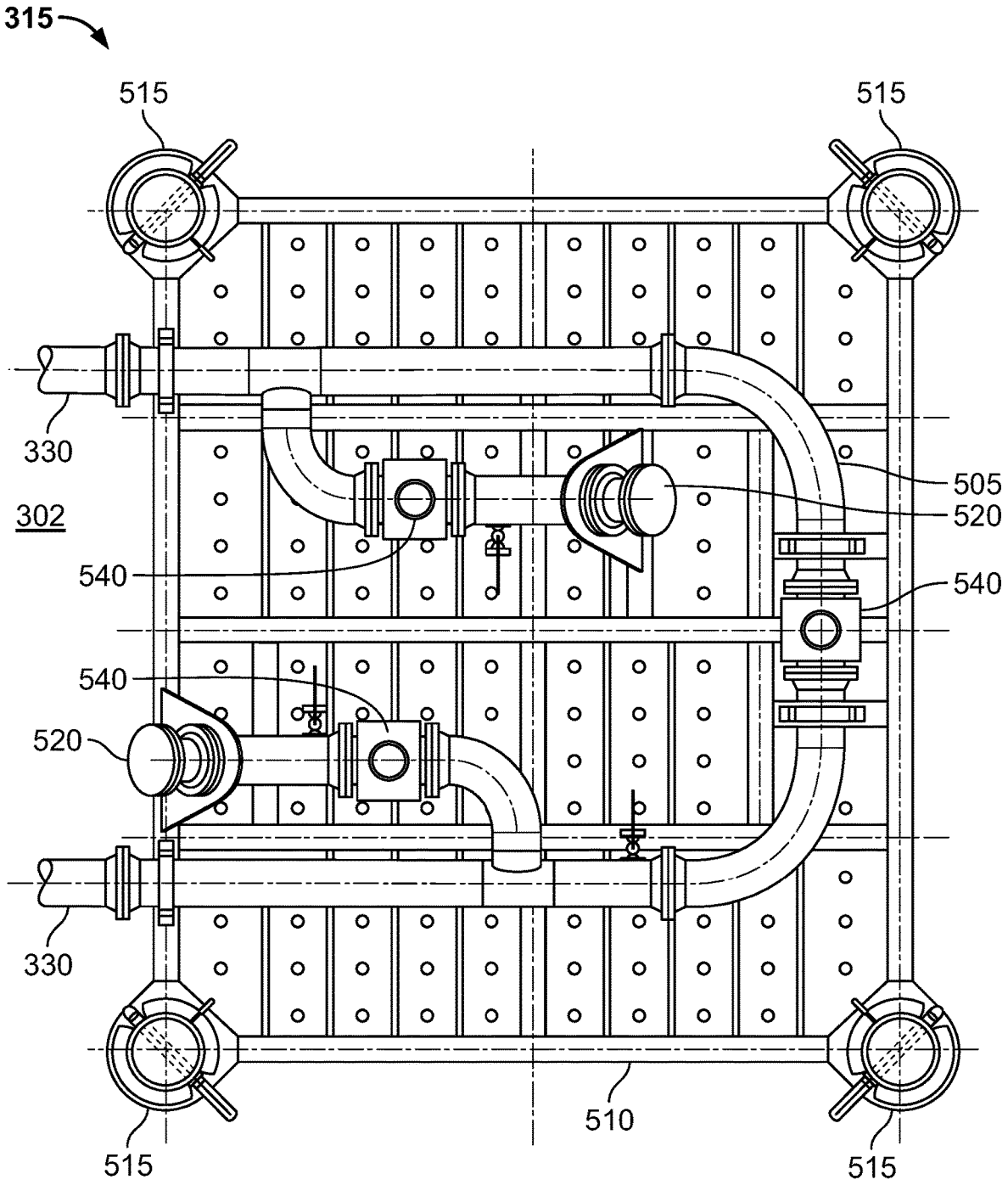
FIG. 5 depicts a schematic plan view of a first pipeline end manifold, according to one or more embodiments.
Figure 6:
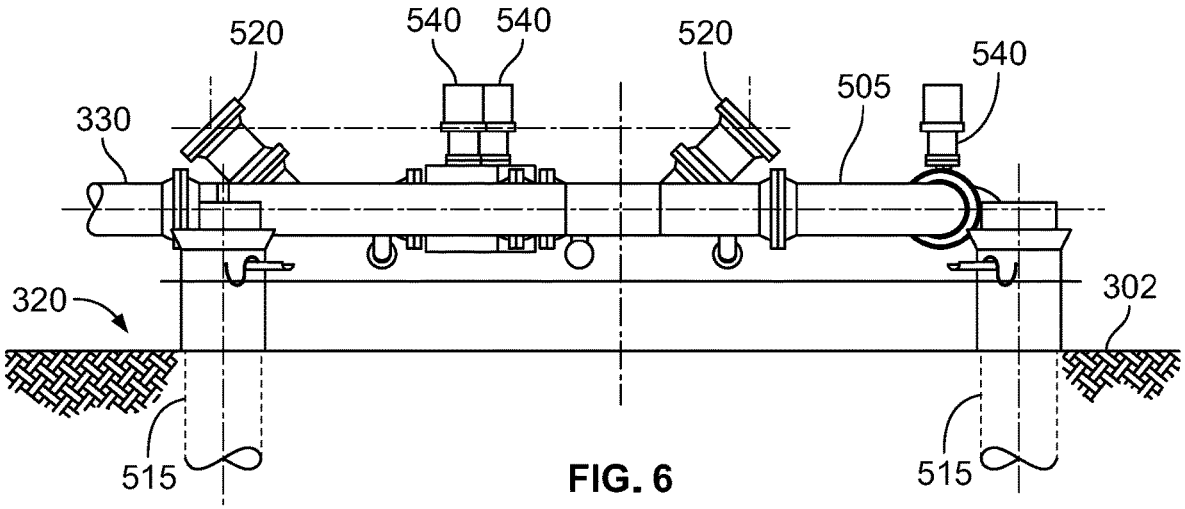
FIG. 6 depicts a schematic elevation view of the first pipeline end manifold shown in FIG. 5.

FIGS. 5 and 6 depict a schematic plan view and a schematic elevation view, respectively, of the first pipeline end manifold 315, according to one or more embodiments. The first pipeline end manifold 315 can include a first pipeline end conduit 505 disposed on a skid 510. The skid 510 can be secured to the seafloor 302 by one or more piles 515 (four are shown) and/or ballast. The first pipeline end conduit 505 can include one or more valves 540 for fluid isolation within one or more portions or sections of the first pipeline end conduit 505. One or more first interface connectors 520 (two are shown) can provide fluid communication from the first interface connectors 520 to the gas pipeline 330. The first pipeline end conduit 505 can have a U-shape or other curved shape to accommodate a pipeline pig for maintenance activities, for example for removal of a condensate from the first pipeline end manifold 315 and/or the gas pipeline 330. A protective cage can surround the first pipeline end conduit 505 and/or the first pipeline end manifold 315 for protection from various environmental hazards.

Figure 7:
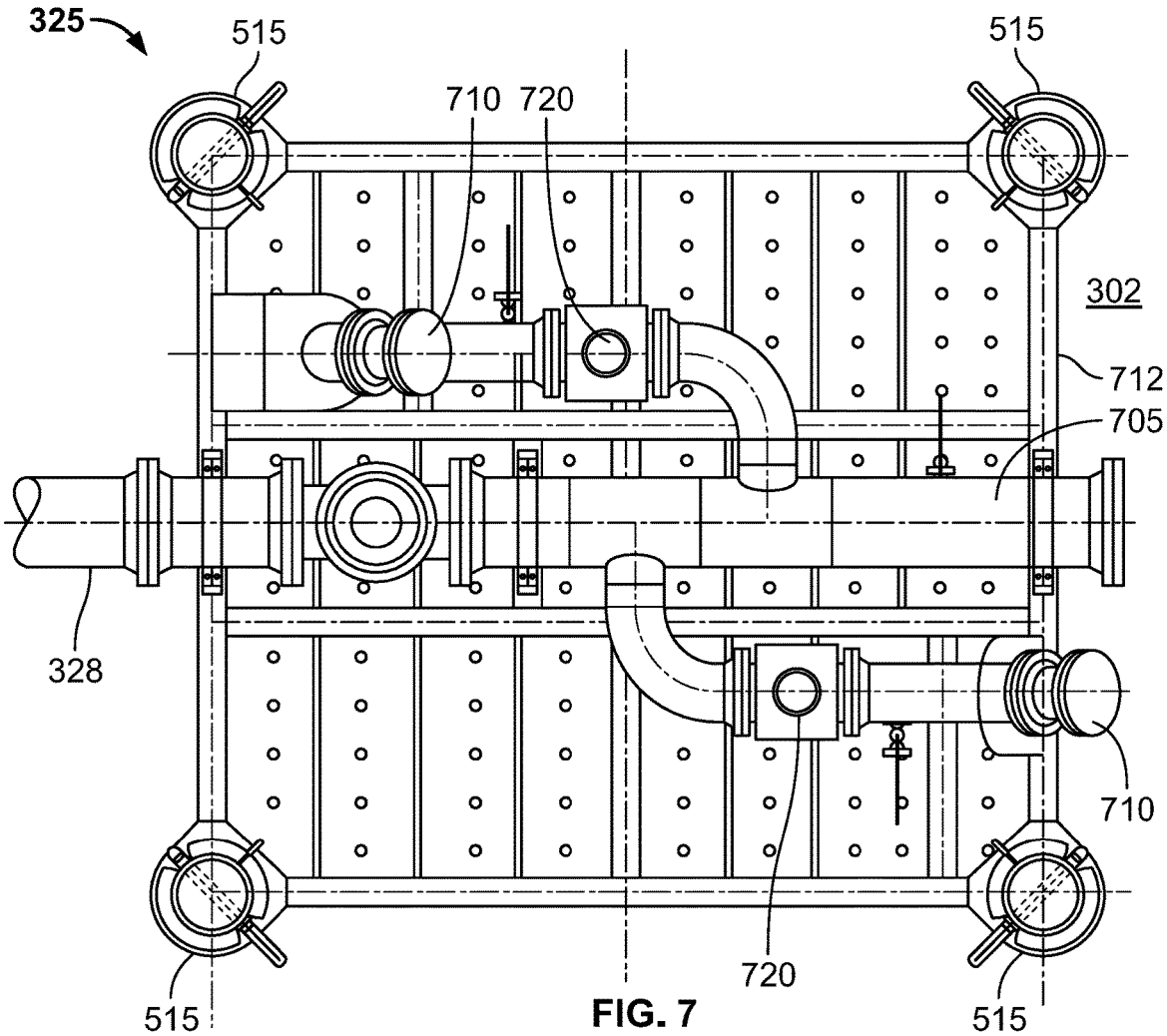
FIG. 7 depict a schematic plan view of a second pipeline end manifold, according to one or more embodiments.
Figure 8:
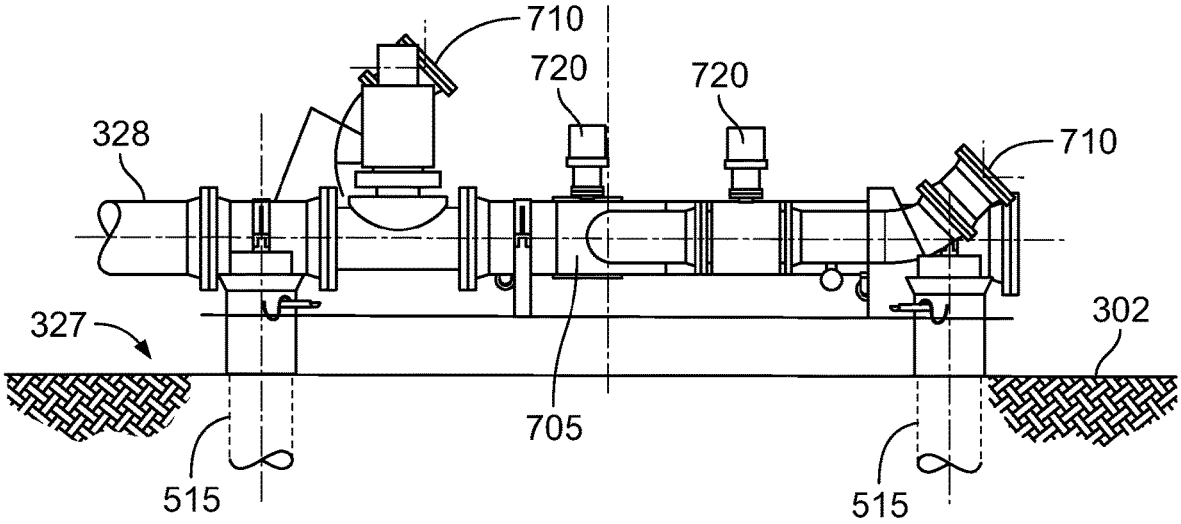
FIG. 8 depict a schematic elevation view of the second pipeline end manifold shown in FIG. 7.

FIGS. 7 and 8 depict a schematic plan view and a schematic elevation view, respectively, of the second pipeline end manifold 325, according to one or more embodiments. The second pipeline end manifold 325 can include a second pipeline end conduit 705 disposed on a skid 712. The skid 712 can be secured to the seafloor 302 by the one or more piles 515 (four are shown) and/or ballast. The second pipeline end conduit 705 can include one or more valves 720 for fluid isolation within one or more portions or sections of the second pipeline end conduit 705. One or more second interface connectors 710 (two are shown) can provide fluid communication from the second interface connectors 710 to the liquid pipeline 328. A protective cage can surround the second pipeline end conduit 705 and/or the second pipeline end manifold 325 for protection from various environmental hazards.

It should be understood that although the first pipeline end manifold 315 and the second pipeline end manifold 325 are depicted as being located at two locations 320, 327 on two different skids 510, 712 at some distance from one another, the first and second pipeline end manifolds 315, 325 can be located adjacent each other and/or formed or assembled on a single skid adapted or configured to accommodate the first pipeline end conduit 505 and the second pipeline end conduit 705.

Figure 9:
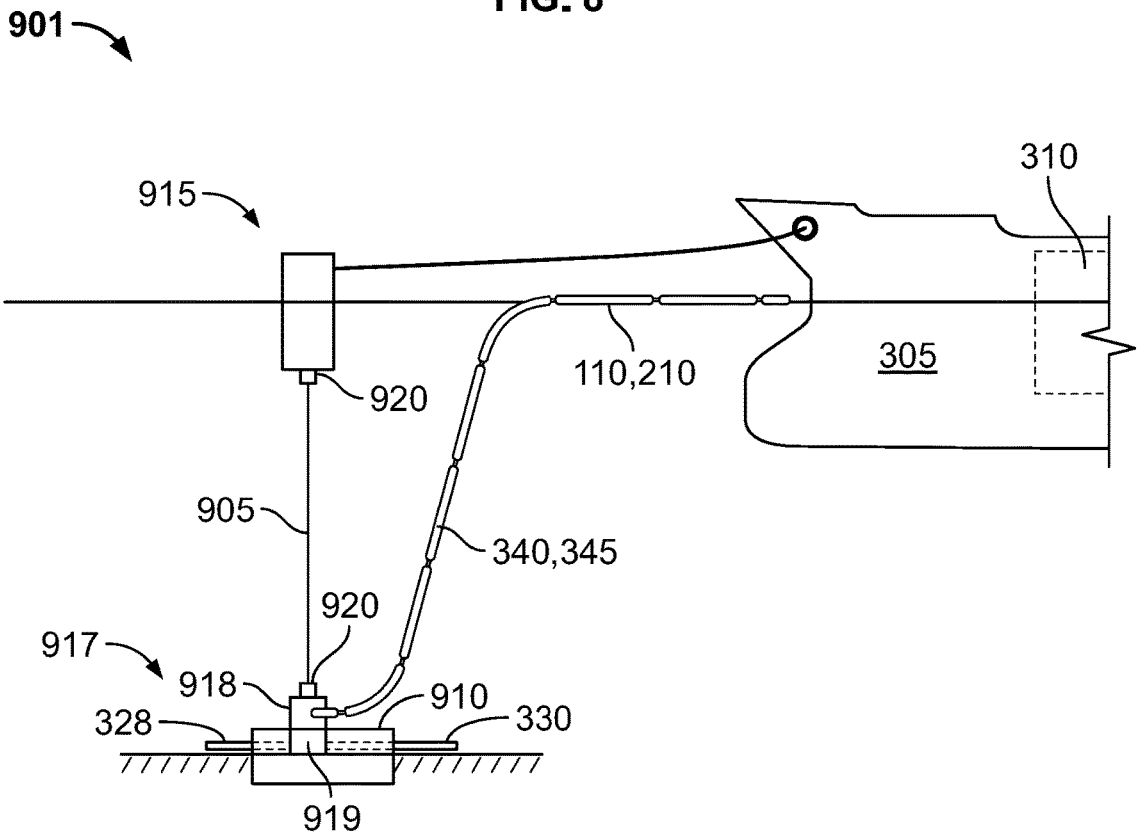
FIG. 9 depicts a schematic of another illustrative single point mooring marine terminal that includes a single anchor leg mooring (SALM) type buoy, according to one or more embodiment.

FIG. 9 depicts a schematic of another illustrative single point mooring marine terminal 901 that includes a single anchor leg mooring (SALM) type buoy 915, according to one or more embodiments. The buoy 915 can be anchored to the seabed by a single anchor leg 905. The single anchor leg 905 can be connected to a base 910 which can be ballasted and/or piled to a subsea location 917. The single anchor leg 905 can be attached to the base 910 by a chain or other elongated member. One or more universal joints 920 (two are shown) can allow the buoy 915 and the floating vessel 305 to rotate about the anchor leg 905 and/or the base 910.

The first floating conduit 110 can be coupled to and in fluid communication with the gas submarine conduit 340. The second floating conduit 210 can be coupled to and in fluid communication with the liquid submarine conduit 345. Although described as separate conduits, the first floating conduit 110 and the gas submarine conduit 340 (and any other conduit) can be a single gas conveyance conduit, i.e., one segment of conduit or a plurality of segments of conduit coupled together. Similarly, although described as separate conduits, the second floating conduit 210 and the liquid submarine conduit 345 can be a single liquid conveyance conduit, i.e., one segment of conduit or a plurality of segments of conduit coupled together.

The gas submarine conduit 340 can be in fluid communication with a first swivel section 918 and the gas pipeline 330. The liquid submarine conduit 345 can be in fluid communication with the the first swivel section 918 and the liquid pipeline 328. The first swivel section 918 and a second swivel section 919 can be adapted or configured to maintain fluid communication between the gas submarine conduit 340 and the gas pipeline 330 during rotation therebetween and when there is no rotation therebetween. The first swivel section 918 and the second swivel section 919 can be adapted or configured to maintain fluid communication between the liquid submarine conduit 345 and the liquid pipeline 328 during rotation therebetween and when there is no rotation therebetween. Liquid can be conveyed from the liquid pipeline 328, through the second and first swivel sections 319 and 318, through the liquid submarine conduit 345, through the second floating conduit 210 and to the vessel 305 and/or the vessel storage tank 310. Gas discharged from the vessel 305 and/or the vessel storage tank 310 can be conveyed through the first floating conduit 110, through the gas submarine conduit 340, through the first and second swivel sections 318 and 319, through the gas pipeline 330 to another location, such as the near-shore or on-shore facility or location.

Figure 10:
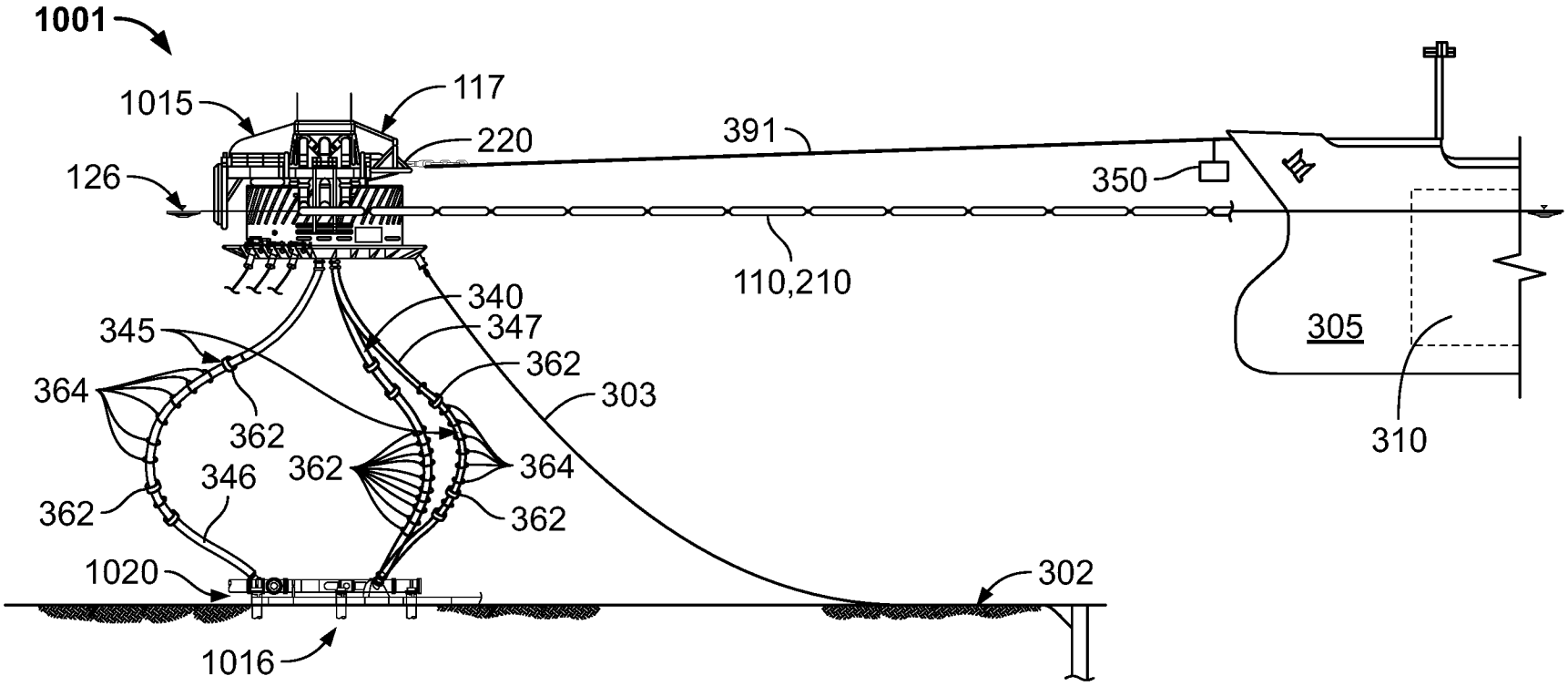
FIG. 10 depicts a schematic elevation view of yet another illustrative single point mooring terminal, including another illustrative buoy, according to one or more embodiments.
Figure 11:
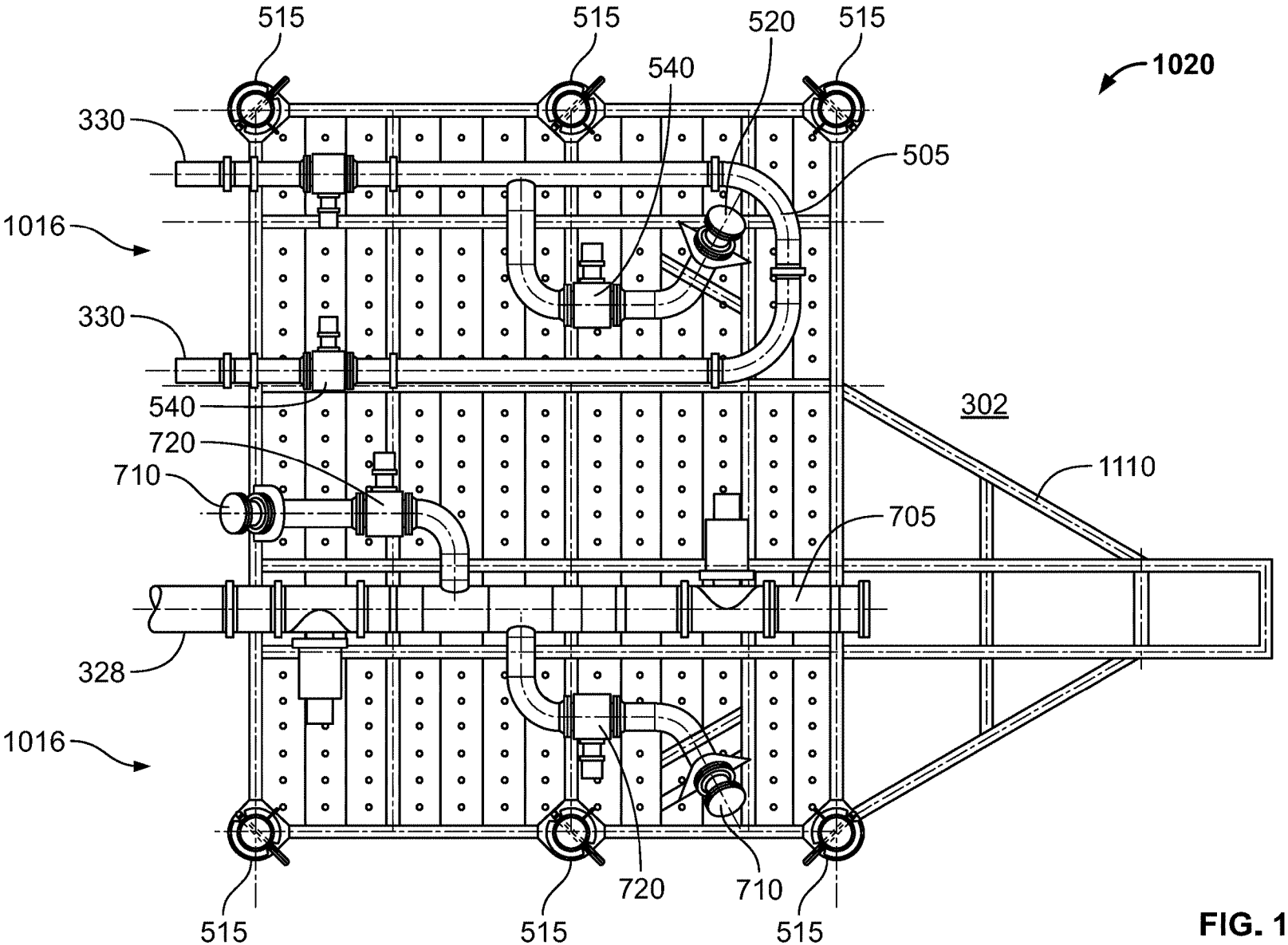
FIG. 11 depicts a schematic plan view of another pipeline end manifold, according to one or more embodiments.

FIG. 10 depicts a schematic elevation view of yet another illustrative single point mooring terminal 1001, including another illustrative buoy 1015, according to one or more embodiments. FIG. 11 depicts a schematic plan view of another pipeline end manifold 1016, according to one or more embodiments. The pipeline end manifold 1016 can be located at a subsea location 1020 and can include the first pipeline end conduit 505 and the second pipeline end conduit 705 disposed on a dual skid 1110. The gas pipeline 330 can be in fluid communication with and span from the pipeline end manifold 1016 to another location, such as a near-shore or on-shore facility or location. The first floating conduit 110, the gas submarine conduit 340 (one is shown), the first pipeline end conduit 505, and the gas pipeline 330 can be adapted or configured to transfer or convey the gas from the floating vessel 305 and/or the vessel storage tank 310, through the buoy 1015, and to the near-shore or on-shore location.

The liquid pipeline 328 can be in fluid communication with and span from the pipeline end manifold 1016 to another location, such as the near-shore or on-shore facility or location. The liquid pipeline 328, the second pipeline end conduit 705, the liquid submarine conduit 345 (two are shown), and the second floating conduit 210 can be adapted or configured to convey the liquid, for example liquid hydrocarbons, from the near-shore or on-shore location, through the buoy 1015, and to the floating vessel 305 and/or the vessel storage tank 310. The gas in the vessel storage tank 310 can be displaced from the vessel storage tank 310 simultaneously with the introduction of the liquid into the vessel storage tank 310.

In some examples, the gas submarine conduit 340 can be configured in a Chinese lantern configuration between the buoy 1015 and the subsea location 1020. The gas submarine conduit 340 can include one or more negatively buoyant members 362 coupled thereto (ten are shown) between the pipeline end manifold 1016 and the buoy 1015. In some examples, the one or more negatively buoyant members 362 can be coupled thereto between the pipeline end manifold 1016 and a midpoint of the gas submarine conduit 340. In other examples, one or more negatively buoyant members 362 can be coupled to the gas submarine conduit 340 between the pipeline end manifold 1016 and the midpoint of the gas submarine conduit 340 and one or more negatively buoyant members 362 can be coupled to the gas submarine conduit 340 between the midpoint and the buoy 1015.

The liquid submarine conduit 345 can be adapted or configured in a Chinese lantern configuration. In some embodiments, one or more positively buoyant members 364 can be distributed along the third submarine conduit 346 and the fourth submarine conduit 347 to maintain the liquid submarine conduit 345 in the Chinese lantern configuration. In other embodiments, one or more positively buoyant members 364 and one or more negatively buoyant members 362 can be distributed along the third submarine conduit 346 and the fourth submarine conduit 347 to maintain the liquid submarine conduit 345 in the Chinese lantern configuration.

It should be understood that rather than a single point mooring marine terminal, other types of mooring systems can be used to moor the floating vessel during transfer or conveyance of the gas from the vessel to the subsea location. In some examples, the vessel can be moored via a spread mooring system during conveyance of the gas from the vessel to the subsea location. A suitable spread mooring system can include the disconnectable spread mooring and riser tower system disclosed in U.S. patent application Ser. No. 16/527,345. In other examples, the vessel can be moored via a stabilized mooring system such as the stabilized mooring system disclosed in U.S. Patent Application No. 62/888,940. In other examples, the vessel can be moored via a disconnectable tower yoke mooring system such as those disclosed in U.S. Pat. No. 9,650,110 and Patent Application Nos. 62/830,082; and 62/830,088.

Embodiments of the present disclosure further relate to any one or more of the following paragraphs:

1. A system for recovering a gas from a vessel, comprising: a buoy comprising a fluid swivel assembly coupled thereto, wherein the fluid swivel assembly comprises a first swivel section rotatably coupled to a second swivel section; a first liquid transfer conduit; a first gas transfer conduit; a second liquid transfer conduit; and a second gas transfer conduit, wherein: the first swivel section and the second swivel section are configured to maintain fluid communication between the first liquid transfer conduit and the second liquid transfer conduit, the first swivel section and the second swivel section are configured to maintain fluid communication between the first gas transfer conduit and the second gas transfer conduit, and the first gas transfer conduit and the second gas transfer conduit are configured to convey a gas from a vessel to a subsea location.

2. The system of paragraph 1, wherein the buoy is floating in water.

3. The system of paragraph 1 or 2, wherein the subsea location is a first subsea location; and wherein the first liquid transfer conduit and the second liquid transfer conduit are configured to convey a liquid from a second subsea location to the vessel.

4. The system according to any of paragraphs 1 to 3, wherein the second gas transfer conduit is configured to convey the gas to a first pipeline end manifold in fluid communication with a gas transfer pipeline disposed at the first subsea location, and wherein the first liquid transfer conduit is configured to convey the liquid from a second pipeline end manifold in fluid communication with a liquid pipeline disposed at the second subsea location.

5. The system according to any of paragraphs 1 to 4, further comprising: a gas submarine conduit in fluid communication with the first pipeline end manifold and the second gas transfer conduit; and a liquid submarine conduit in fluid communication with the second pipeline end manifold and the first liquid transfer conduit, wherein the gas submarine conduit and the liquid submarine conduit are independently configured in a Chinese lantern configuration, a steep-S configuration, or a lazy-S configuration between the floating buoy and the first and second subsea locations.

6. The system according to any of paragraphs 1 to 5, wherein: the buoy is secured to the seafloor and held in a relatively geostationary condition by one or more anchor legs, and the first swivel section rotates with a rotatable turntable coupled to the buoy.

7. The system according to any of paragraphs 1 to 6, further comprising: a first floating conduit in fluid communication with the first gas transfer conduit, wherein the first floating conduit is configured to convey the gas between the vessel storage tank and the first gas transfer conduit, and a second floating conduit in fluid communication with the second liquid transfer conduit, wherein the second floating conduit is configured to convey a liquid between the second liquid transfer conduit and the vessel storage tank.

8. The system according to any of paragraphs 1 to 7, wherein the buoy is configured to be a single point mooring marine terminal, and wherein a vessel moored thereto weathervanes about the floating buoy.

9. The system according to any of paragraphs 1 to 8, wherein the buoy is a catenary anchor leg mooring type buoy or a single anchor leg mooring type buoy.

10. The system according to any of paragraphs 1 to 9, wherein the second gas transfer conduit extends from the second swivel section and transitions into two or more second gas transfer conduits.

11. The system according to any of paragraphs 1 to 10, wherein: the buoy is a floating in water to provide a floating buoy, and each of the two or more gas transfer conduits are in fluid communication with a pipeline end manifold in fluid communication with a gas transfer pipeline located at the subsea location.

12. The system according to any of paragraphs 1 to 11, wherein the gas comprises an exhaust gas.

13. The system according to any of paragraphs 1 to 12, wherein: the first gas transfer conduit is in fluid communication with a first flow path defined by the first swivel section, the second gas transfer conduit is in fluid communication with a first flow path defined by the second swivel section, the first liquid transfer conduit is in fluid communication with a second flow path defined by the second swivel section, and the second liquid transfer conduit is in fluid communication with a second flow path defined by the first swivel section.

14. A process for recovering a gas from a vessel, comprising: flowing a gas displaced from a vessel storage tank through a first gas transfer conduit, through a floating buoy, through a second gas transfer conduit to a first subsea location; and flowing a liquid from a second subsea location through a first liquid transfer conduit, through the floating buoy, and through a second liquid transfer conduit into the vessel storage tank.

15. The process of paragraph 14, wherein the first liquid transfer conduit and the second gas transfer conduit are independently configured to operate in a Chinese lantern configuration, a steep-S configuration, or a lazy-S configuration below the floating buoy.

16. The process of paragraph 14 or 15, wherein the floating buoy is configured to be a single point mooring marine terminal.

17. The process according to any of paragraphs 14 to 16, wherein: the floating buoy comprises: a fluid swivel assembly coupled thereto, the fluid swivel assembly comprises a first swivel section rotatably coupled to a second swivel section, the first swivel section and the second swivel section are configured to maintain fluid communication between the first liquid transfer conduit and the second liquid transfer conduit during rotation therebetween, and the first swivel section and the second swivel section are configured to maintain fluid communication between the first gas transfer conduit and the second gas transfer conduit during rotation therebetween.

18. The process according to any of paragraphs 14 to 17, wherein: the liquid flows through the second liquid transfer conduit, through a second floating conduit, and into the vessel storage tank; and the gas simultaneously flows from the vessel storage tank, through a first floating conduit, and into the first gas transfer conduit.

19. The process according to any of paragraphs 14 to 18, wherein: the first gas transfer conduit is in fluid communication with a first flow path defined by the first swivel section, the second gas transfer conduit is in fluid communication with a first flow path defined by the second swivel section, the first liquid transfer conduit is in fluid communication with a second flow path defined by the second swivel section, and the second liquid transfer conduit is in fluid communication with a second flow path defined by the first swivel section.

20. The process according to any of paragraphs 14 to 19, wherein the gas comprises an inert gas.

21. A system for recovering a gas from a vessel, comprising: a floating buoy comprising: a rotatable turntable, wherein: the rotatable turntable comprises a fluid swivel assembly coupled thereto, and the fluid swivel assembly comprises a first swivel section rotatably coupled to a second swivel section; a first liquid transfer conduit in fluid communication with a second flow path defined by the second swivel section; a second liquid transfer conduit in fluid communication with a second flow path defined by the first swivel section; a first floating conduit in fluid communication with a first gas transfer conduit, wherein the first gas transfer conduit is in fluid communication with a first flow path defined by the first swivel section; a second gas transfer conduit in fluid communication with a first flow path defined by the second swivel section; and a second floating conduit in fluid communication with the second liquid transfer conduit; wherein: the first swivel section and the second swivel section are configured to maintain fluid communication between the first liquid transfer conduit and the second liquid transfer conduit during rotation therebetween, the first swivel section and the second swivel section are configured to maintain fluid communication between the first gas transfer conduit and the second gas transfer conduit during rotation therebetween, the first liquid transfer conduit, the second liquid transfer conduit, and the second floating conduit are configured to convey a liquid from a liquid pipeline end manifold located subsea into a vessel storage tank, the first floating conduit, the first gas transfer conduit, and the second gas transfer conduit are configured to convey a gas discharged from a vessel storage tank into a gas pipeline end manifold located subsea when the liquid is conveyed into the vessel storage tank, the first liquid transfer conduit is configured to operate in a Chinese lantern configuration, a steep-S configuration, or a lazy-S configuration below the floating buoy, and the second gas transfer conduit is configured to operate in a Chinese lantern configuration below the floating buoy.

22. The system of paragraph 21, wherein the floating buoy is configured to be a single point mooring marine terminal.

23. The system or process according to any one of paragraphs 1 to 22, wherein the liquid comprises water.

24. The system or process according to any one of paragraphs 1 to 23, wherein the liquid comprises raw hydrocarbons.

25. The system or process according to any one of paragraphs 1 to 24, wherein the liquid comprises crude oil or a fraction thereof.

26. The system or process according to any one of paragraphs 1 to 25, wherein the liquid comprises refined hydrocarbons.

27. The system or process according to any one of paragraphs 1 to 26, wherein the liquid comprises diesel fuel, jet fuel, kerosene, gasoline, or a mixture thereof.

28. The system or process according to any one of paragraphs 1 to 27, wherein the gas comprises an exhaust gas, air, an inert gas such as nitrogen or carbon dioxide, a hydrocarbon gas, or any mixture thereof.

29. The system or process according to any one of paragraphs 1 to 28, wherein the gas comprises an exhaust gas.

30. The system according to any one of paragraph 5 to 13 or 29, wherein the gas submarine conduit comprises one or more negatively buoyant members coupled thereto.

31. The system according to paragraph 30, wherein the one or more negatively buoyant members coupled to the gas submarine conduit urge the gas submarine conduit toward a seafloor to maintain the gas submarine conduit in a Chinese lantern configuration.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim can be not defined above, it should be given the broadest definition persons in the pertinent art have given that term as reflected in at least one printed publication or issued patent. Furthermore, all patents, test procedures, and other documents cited in this application are fully incorporated by reference to the extent such disclosure can be not inconsistent with this application and for all jurisdictions in which such incorporation can be permitted.

While certain preferred embodiments of the present invention have been illustrated and described in detail above, it can be apparent that modifications and adaptations thereof will occur to those having ordinary skill in the art. It should be, therefore, expressly understood that such modifications and adaptations may be devised without departing from the basic scope thereof, and the scope thereof can be determined by the claims that follow.

What is claimed is:

1. A system for recovering a gas from a vessel, comprising:

a buoy floating in water, the buoy comprising a fluid swivel assembly coupled to the buoy, wherein the fluid swivel assembly comprises a first swivel section rotatably coupled to a second swivel section;

a first liquid transfer conduit;

a first gas transfer conduit;

a second liquid transfer conduit; and a second gas transfer conduit, wherein:

the first swivel section and the second swivel section are configured to maintain fluid communication between the first liquid transfer conduit and the second liquid transfer conduit, the first swivel section and the second swivel section are configured to maintain fluid communication between the first gas transfer conduit and the second gas transfer conduit, the first gas transfer conduit and the second gas transfer conduit are configured to convey a gas from the vessel to a first pipeline end manifold in fluid communication with a gas transfer pipeline disposed at a first subsea location, and the first liquid transfer conduit and the second liquid transfer conduit are configured to convey a liquid from a second pipeline end manifold in fluid communication with a liquid pipeline disposed at a second subsea location to the vessel.

2. The system of claim 1, further comprising:

a gas submarine conduit in fluid communication with the first pipeline end manifold and the second gas transfer conduit; and a liquid submarine conduit in fluid communication with the second pipeline end manifold and the first liquid transfer conduit, wherein the gas submarine conduit and the liquid submarine conduit are independently configured in a Chinese lantern configuration, a steep-S configuration, or a lazy-S configuration between the buoy and the first and second subsea locations.

3. The system of claim 1, wherein:

the buoy is secured to the seafloor and held in a relatively geostationary condition by one or more anchor legs, and the first swivel section rotates with a rotatable turntable coupled to the buoy.

4. The system of claim 1, further comprising:

a first floating conduit in fluid communication with the first gas transfer conduit, wherein the first floating conduit is configured to convey the gas between a storage tank on the vessel and the first gas transfer conduit, and a second floating conduit in fluid communication with the second liquid transfer conduit, wherein the second floating conduit is configured to convey a liquid between the second liquid transfer conduit and the vessel storage tank.

5. The system of claim 1, wherein the buoy is a single point mooring marine terminal, and wherein the vessel is moored to the buoy and weathervanes about the buoy.

6. The system of claim 5, wherein the buoy is a catenary anchor leg mooring type buoy or a single anchor leg mooring type buoy.

7. The system of claim 1, wherein the second gas transfer conduit extends from the second swivel section and transitions into two or more second gas transfer conduits.

8. The system of claim 7, wherein each of the two or more gas transfer conduits are in fluid communication with the first pipeline end manifold.

9. The system of claim 1, wherein the gas comprises an exhaust gas, and wherein the exhaust gas comprises an oxide of sulfur, an oxide of nitrogen, or a mixture thereof.

10. The system of claim 1, wherein:

the first gas transfer conduit is in fluid communication with a first flow path defined by the first swivel section, the second gas transfer conduit is in fluid communication with a first flow path defined by the second swivel section, the first liquid transfer conduit is in fluid communication with a second flow path defined by the second swivel section, and the second liquid transfer conduit is in fluid communication with a second flow path defined by the first swivel section.

11. A process for recovering a gas from a vessel, comprising:

flowing a gas displaced from a storage tank on the vessel through a first gas transfer conduit, through a floating buoy, and through a second gas transfer conduit to a first pipeline end manifold in fluid communication with a gas transfer pipeline disposed at a first subsea location; and flowing a liquid from a second pipeline end manifold in fluid communication with a liquid pipeline disposed at a second subsea location through a first liquid transfer conduit, through the floating buoy, and through a second liquid transfer conduit into the vessel storage tank.

12. The process of claim 11, wherein the first liquid transfer conduit and the second gas transfer conduit are independently configured to operate in a Chinese lantern configuration, a steep-S configuration, or a lazy-S configuration below the floating buoy.

13. The process of claim 11, wherein the floating buoy is a single point mooring marine terminal.

14. The process of claim 11, wherein:

the floating buoy comprises:

a fluid swivel assembly coupled to the buoy, the fluid swivel assembly comprises a first swivel section rotatably coupled to a second swivel section, the first swivel section and the second swivel section are configured to maintain fluid communication between the first liquid transfer conduit and the second liquid transfer conduit during rotation between the first and second swivel sections, and the first swivel section and the second swivel section are configured to maintain fluid communication between the first gas transfer conduit and the second gas transfer conduit during rotation between the first and second swivel sections.

15. The process of claim 14, wherein:

the liquid flows through the second liquid transfer conduit, through a second floating conduit, and into the storage tank; and the gas simultaneously flows from the storage tank, through a first floating conduit, and into the first gas transfer conduit.

16. The process of claim 14, wherein:

the first gas transfer conduit is in fluid communication with a first flow path defined by the first swivel section, the second gas transfer conduit is in fluid communication with a first flow path defined by the second swivel section, the first liquid transfer conduit is in fluid communication with a second flow path defined by the second swivel section, and the second liquid transfer conduit is in fluid communication with a second flow path defined by the first swivel section.

17. A system for recovering a gas from a vessel, comprising:

a floating buoy comprising:

a rotatable turntable, wherein:

the rotatable turntable comprises a fluid swivel assembly coupled to the floating buoy, and the fluid swivel assembly comprises a first swivel section rotatably coupled to a second swivel section;

a first floating conduit in fluid communication with a first gas transfer conduit, wherein the first gas transfer conduit is in fluid communication with a first flow path defined by the first swivel section;

a second gas transfer conduit in fluid communication with a first flow path defined by the second swivel section;

a gas submarine conduit in fluid communication with the second gas transfer conduit and a gas pipeline end manifold located subsea;

a liquid submarine conduit in fluid communication with a liquid pipeline end manifold and a first liquid transfer conduit, wherein the first liquid transfer conduit is in fluid communication with a second flow path defined by the second swivel section;

a second liquid transfer conduit in fluid communication with a second flow path defined by the first swivel section; and a second floating conduit in fluid communication with the second liquid transfer conduit;

wherein:

the first swivel section and the second swivel section are configured to maintain fluid communication between the first gas transfer conduit and the second gas transfer conduit, the first swivel section and the second swivel section are configured to maintain fluid communication between the first liquid transfer conduit and the second liquid transfer conduit, the liquid submarine conduit, the first liquid transfer conduit, the second liquid transfer conduit, and the second floating conduit are configured to convey a liquid from the liquid pipeline end manifold into a storage tank on the vessel, the first floating conduit, the first gas transfer conduit, the second gas transfer conduit, and the gas submarine conduit are configured to convey a gas discharged from the storage tank into the gas pipeline end manifold when the liquid is conveyed into the storage tank, the liquid submarine conduit is configured to operate in a Chinese lantern configuration, a steep-S configuration, or a lazy-S configuration below the floating buoy, and the gas submarine conduit is configured to operate in a Chinese lantern configuration below the floating buoy.

18. The system of claim 1, wherein the gas comprises nitrogen, carbon dioxide, or a mixture thereof.

19. The system of claim 1, wherein the buoy is a turntable buoy or a turret buoy.

20. The system of claim 2, wherein the gas submarine conduit comprises one or more negatively buoyant members coupled thereto, and wherein the one or more negatively buoyant members coupled to the gas submarine conduit urge the gas submarine conduit toward a seafloor to maintain the gas submarine conduit in a Chinese lantern configuration.

21. The process of claim 11, wherein the gas comprises an exhaust gas, and wherein the exhaust gas comprises an oxide of sulfur, an oxide of nitrogen, or a mixture thereof.

22. The process of claim 11, wherein the gas comprises nitrogen, carbon dioxide, or a mixture thereof.

23. The process of claim 11, wherein the floating buoy is a turntable buoy or a turret buoy.

* * * * *